US010280719B1

(12) United States Patent
O'Neal

(10) Patent No.: US 10,280,719 B1
(45) Date of Patent: May 7, 2019

(54) METHOD AND APPARATUS FOR INSTALLATION AND REMOVAL OF INLINE FILTER SCREENS AND OTHER OBJECTS

(71) Applicant: Don Mashburn, Inc., Broussard, LA (US)

(72) Inventor: Adam O'Neal, Lafayette, LA (US)

( * ) Notice: Subject to any disclaimer, the term of this patent is extended or adjusted under 35 U.S.C. 154(b) by 0 days.

(21) Appl. No.: 16/055,378

(22) Filed: Aug. 6, 2018

Related U.S. Application Data

(60) Provisional application No. 62/623,798, filed on Jan. 30, 2018.

(51) Int. Cl.

| | |
|---|---|
| ***E21B 43/08*** | (2006.01) |
| ***E21B 43/10*** | (2006.01) |
| ***E21B 34/14*** | (2006.01) |
| *E21B 34/00* | (2006.01) |

(52) U.S. Cl.
CPC ..... *E21B 43/086* (2013.01); *E21B 34/14* (2013.01); *E21B 43/10* (2013.01); *E21B 2034/007* (2013.01)

(58) Field of Classification Search
CPC ..... E21B 43/086; E21B 43/10; E21B 34/14; E21B 2034/007
USPC ..... 210/767, 435, 445, 446, 447, 449, 450, 210/451, 453, 455
See application file for complete search history.

(56) References Cited

U.S. PATENT DOCUMENTS

| | | | | |
|---|---|---|---|---|
| 3,369,665 | A | 2/1968 | Paulson | |
| 3,804,258 | A | 4/1974 | Okuniewski et al. | |
| 4,599,172 | A | 7/1986 | Gardes | |
| 8,172,771 | B2 * | 5/2012 | Miller | A61B 10/0041 210/232 |
| 2007/0102332 | A1 * | 5/2007 | Bommi | B01D 21/0012 210/136 |
| 2009/0229671 | A1 | 9/2009 | Harnett et al. | |

FOREIGN PATENT DOCUMENTS

| | | |
|---|---|---|
| JP | 2005-144438 A | 6/2005 |

OTHER PUBLICATIONS

PCT International Search Report and Written Opinion dated Nov. 2, 2018.

* cited by examiner

*Primary Examiner* — Madeline Gonzalez
(74) *Attorney, Agent, or Firm* — Ted M. Anthony

(57) ABSTRACT

A method and apparatus for installing an object in a flow line or other compartment, such as a surface inline filter assembly having a removable screen filter apparatus. A housing has a central through bore and an elongate slot or opening with a cover that can be selectively opened or locked in a closed position when desired. A filter apparatus can be loaded within the assembly, and shifted into a locked position within the central bore of the housing. When removal of the filter apparatus is desired, the cover can be unlocked and opened, and the filter apparatus can be quickly and efficiently removed, cleaned and/or replaced.

13 Claims, 11 Drawing Sheets

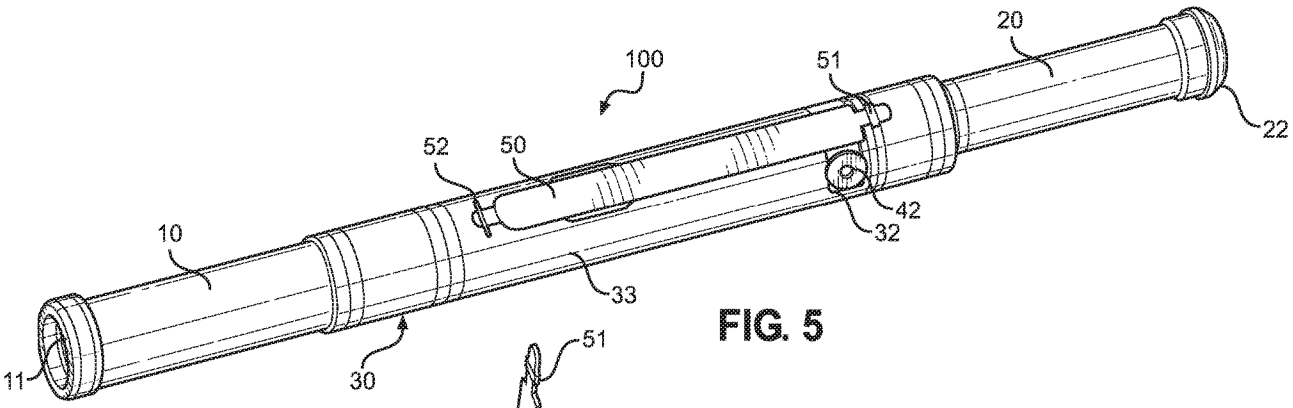
FIG. 5
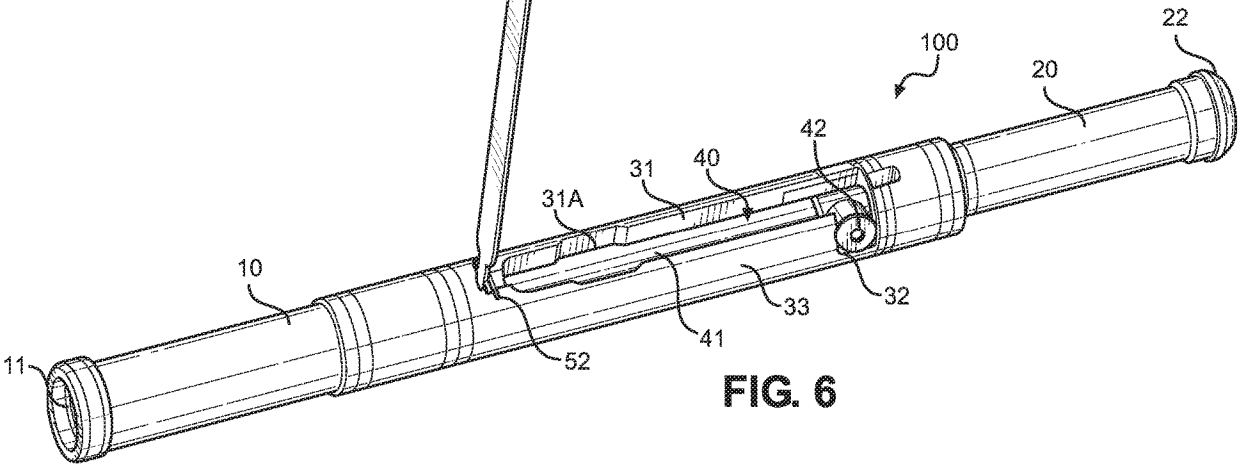
FIG. 6
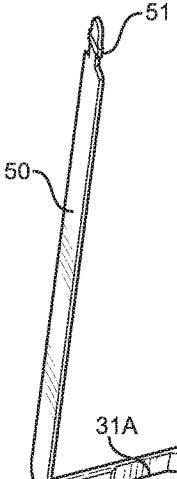

METHOD AND APPARATUS FOR INSTALLATION AND REMOVAL OF INLINE FILTER SCREENS AND OTHER OBJECTS

CROSS REFERENCES TO RELATED APPLICATION

This Application claims priority of U.S. Provisional Patent Application Ser. No. 62/623,798, filed Jan. 30, 2018, incorporated herein by reference.

STATEMENTS AS TO THE RIGHTS TO THE INVENTION MADE UNDER FEDERALLY SPONSORED RESEARCH AND DEVELOPMENT

None

FIELD OF THE INVENTION

The present invention pertains to a method and apparatus for filtering fluid. More particularly, the present invention pertains to a method and apparatus for installing a filter apparatus within, and removing said filter apparatus from, a fluid flow line. More particularly still, the present invention pertains to surface filtering of drilling mud and/or other fluids including, without limitation, a method and apparatus for the safe and efficient installation and/or removal of a filtration apparatus.

BACKGROUND OF THE INVENTION

The use of drilling fluids for the drilling of oil and gas wells is well known. Said drilling fluid serves many purposes, including suppression of reservoir fluid pressure, lubrication of drill pipe and drill bits, and cooling of bottom hole assemblies and the like. Said bottom hole assemblies may contain individual components such as bits, stabilizers, measurement while drilling tools and the like. Frequently, such bottom hole assemblies contain electronic sections such as microprocessors that are used to collect and/or transmit data collected by sensors placed in the bottom hole assemblies.

Drilling fluids may contain many different types of components such as mud, clay, weighting materials, chemicals, drill cuttings, metal shavings, and the like. The size of these components can vary from microns to inches. Additionally, drilling rig personnel may inadvertently drop tools, gloves, rags and/or other unwanted materials into a well bore. Such unwanted and/or undesirable solid materials, hereinafter referred to as debris, can be very harmful to the safe and efficient operation of drilling rigs and/or related drilling operations. By way of illustration, but not limitation, such debris can cause failures in the electrical components of bottom hole assemblies. As a result, it is often desirable to filter drilling fluid to remove debris and contaminants from said drilling fluids.

Many methods of filtering well bore fluids exist. One conventional method involves installing at least one filter apparatus into at least one tubular member while a plurality of tubular members is being run into a well bore; at least one filter apparatus is installed in a pipe section at the earth's surface, and is subsequently conveyed to a downhole location as part of an elongate pipe string. Said conventional downhole filter members typically each comprise a substantially cylindrical screen apparatus having an external upwardly-facing fishing neck disposed at an upper end.

However, these types of filtration devices have many disadvantages including, without limitation, limited flow through area at said upper ends.

In some instances, it has proven beneficial to filter said drilling fluids at or near the earth's surface (that is, near the upper opening of a wellbore), such as on a drilling rig. Frequently, a substantially cylindrical filter screen apparatus can be installed at a well's surface and typically remains within drill pipe or other tubular workstring above a rig floor. In such cases, said substantially cylindrical filter screen must be removed from said pipe string following connection or disconnection of pipe segments (joints or stands) above the rig floor. During this process, the filter screen apparatus must be conveyed to an elevated location within a drilling rig derrick and removed from said pipe, which creates a drop hazard to personnel and/or property situated there below.

Alternatively, a filter apparatus is typically installed within a flow manifold situated between the mud pumps of a drilling rig and the inlet of a wellbore. Said flow manifolds typically include a Y-shaped flow junction member that permits removal of said filter apparatus from said flow manifold for cleaning and/or debris removal. However, said conventional flow junctions are relatively large and expensive; further, it is typically very time consuming to stop pumping operations, open said conventional flow manifold, remove a filter apparatus, clean/replace said filter apparatus, and then close the flow manifold in order to resume fluid pumping operations.

Thus, there is a need for a method and apparatus for filtering of drilling mud and/or other fluids. There is also a need for a filtering apparatus that can be retrieved from a surface fluid flow manifold, quickly, safely and efficiently. These needs, as well as many others, are satisfied by the invention herein disclosed.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

FIG. 5 depicts a perspective view of a flow line filter assembly of the present invention in a closed, loaded and locked configuration.

FIG. 6 depicts a perspective view of a flow line filter assembly of the present invention in a loaded and locked configuration, with a hinged cover member open.

SUMMARY OF THE INVENTION

In a preferred embodiment, the present invention comprises a flow line filter assembly having an inlet sub, an outlet sub and a filter housing assembly disposed there between. Although said inlet sub, outlet sub and filter housing assembly are described herein as separate components, it is to be observed that said components can comprise a member of singular or unitary construction without departing from the scope of the present invention.

In a preferred embodiment, said filter housing assembly generally comprises a cylindrical body or housing member having a central through bore and an elongate slot or aperture; in a preferred embodiment, said elongate slot is oriented substantially parallel to the longitudinal axis of said housing member and its central through bore, and extends from the outer surface of said housing member to said central through bore. Said elongate slot further comprises a transverse side notch or recess. Said side notch or recess extends in a substantially perpendicular orientation from the longitudinal axis of said elongate slot.

A door or cover member is hingedly attached to said housing. Said door member can selectively alternate between an open position (wherein it is clear of said elongate slot), and a closed position wherein said door member is at least partially received within said elongate slot.

An elongate filter locking sleeve member having a body section is slidably disposed within an elongate central bore of said filter housing. Said filter locking sleeve further includes a knob-like locking extension that protrudes radially outward from an outer surface of said locking sleeve and is slidably received within said elongate slot. When said filter locking sleeve member is rotated, said knob-like locking extension can be received within said side notch, thereby selectively preventing or locking said elongate filter locking sleeve member against axial movement.

In a preferred embodiment, said locking sleeve and a filter apparatus (typically a cylindrical screen filter) can be operationally attached in end-to-end orientation. Said filter apparatus can be selectively locked in place during operation and, when desired, removed via said elongate slot as more fully set forth herein.

DETAILED DESCRIPTION OF THE PREFERRED EMBODIMENT

Figure 1:
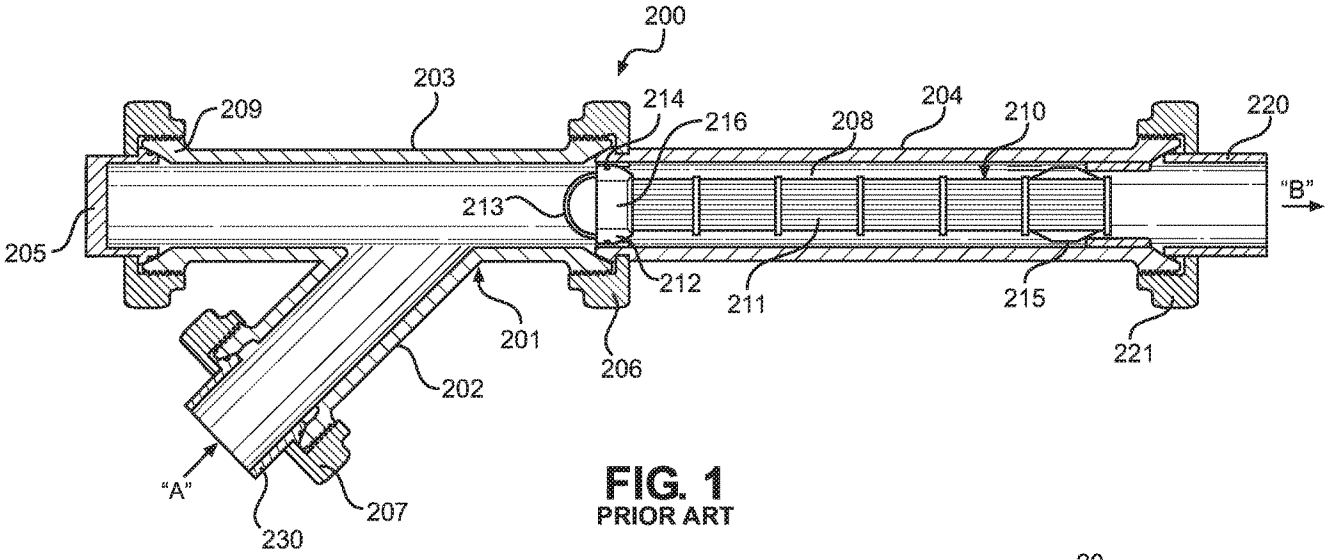
FIG. 1 PRIOR ART
FIG. 1 depicts an overhead sectional view of a prior art conventional flow line filter assembly.

Referring to the drawings, FIG. 1 depicts an overhead sectional view of a prior art conventional surface flow line filter assembly 200. Conventional flow line filter assembly 200 generally comprises a substantially Y-shaped flow junction member 201 having a fluid inlet conduit 202 defining a central through bore, and filter retrieval housing 203 also defining a central through bore. In the embodiment depicted in FIG. 1, blank cap 205, which can be a conventional blanked hammer union or other conventional blank-off end piece, is installed on filter retrieval housing 203 and blanks-off/seals an opening at an end 209 of said filter retrieval housing 203. A flow line or input conduit 230 is connected to fluid inlet conduit 202 using union member 207; said union member 207 can comprise a conventional hammer union or other conventional threaded connection member.

Still referring to FIG. 1, filter housing member 204 having central internal through bore 208 is attached to said Y-shaped flow junction member 201 using union member 206. Said union member 206 can comprise a conventional hammer union or other conventional threaded connection member. In a preferred embodiment, said filter housing member 204 is substantially axially aligned with said screen retrieval housing 203. A flow line or output conduit 220 is connected to filter housing member 204 using union member 221. Said union member 221 can comprise a conventional hammer union or other conventional threaded connection member.

Conventional filter assembly 210 is depicted installed within central through bore 208 of linear housing member 204. In the configuration depicted in FIG. 1, said conventional filter assembly 210 has a substantially cylindrical shape, and comprises filter screen segment 211 and inlet head 212. Said filter screen segment 211 has an outer diameter that is less than the inner diameter of central through bore 208 of linear housing member 204. A retrieval loop 213 is also attached to said inlet head 212, while radial screen fins 215 act to concentrically centralize filter screen segment 211 within central through bore 208. At least one seal member 214 (which can comprise an O-ring or elastomeric seal member) is disposed along the outer surface of inlet head 212, and can cooperate with an inner surface of central through bore 208 to form a fluid-pressure seal.

Although other configurations can be employed without departing from the scope of the present invention, in most applications said conventional flow line filter assembly 200 is beneficially positioned between mud pumps of a drilling rig and a fluid inlet of a wellbore. Still referring to FIG. 1, in such a configuration, fluid can flow from said mud pumps, through flow line 230, through inlet line 202 in direction "A", through a central bore of filter retrieval housing 203, through bore 216 of inlet head 212 of filter assembly 210, into central through bore 208 of filter housing 204, and out through output conduit 220 in the direction "B". Said fluid is prevented from flowing around the outer surface of inlet head 212 due to the fluid pressure seal formed by at least one seal member 214.

When flowing along the aforementioned flow path, said fluid passes through filter screen segment 211 of filter assembly 210. Said filter screen segment 211 filters and removes solids and/or other debris exceeding a predetermined size from said fluid flow stream. It is to be observed that said solids and/or other debris cannot pass through openings formed by said filter screen segment 211 and, consequently, remains trapped within the inner portion of said filter screen segment 211.

Eventually, a sufficient quantity of solids and/or other debris can build up within the inner portion of said filter screen segment 211, thereby blocking openings formed in said filter screen segment 211 and creating a restriction to fluid flow through said filter screen segment 211. In such cases, or in any other circumstance where removal and cleaning of filter assembly 210 is desired, fluid flow through said conventional flow line filter assembly 200 can be interrupted (such as, for example, by stopping mud pumps or other source of pressurized fluid entering through inlet conduit 202).

Hammer union blank cap 205 can be opened or removed, thereby providing access to the central through bore of filter retrieval housing 203. A hook or other similar filter retrieval tool can be inserted through said central bore until it hooks or otherwise attaches to loop 213. Force generally in the direction of end 209 can be applied to loop 213 using said hook or other retrieval tool, resulting in movement of filter assembly 210 from central bore 208 of filter housing 204. Specifically, said filter assembly 210 can be pulled through filter retrieval housing 203 and, ultimately, out open end 209 thereof. Once filter assembly 210 is removed in this manner, solids and/or other debris can be cleaned or otherwise removed from the inner portion of filter screen segment 211. Thereafter, said (clean) filter assembly 210 can be reinstalled within central bore 208 of filter housing 204 by repeating the above process in reverse, and fluid filtering operations can recommence.

As discussed, above said conventional flow junctions (such as flow junction assembly 201) are relatively large, heavy and expensive to manufacture. Further, it is typically a time-consuming and labor intensive process to interrupt fluid flow, open hammer union cap 205, remove a filter assembly 210 from filter housing 204, clean/replace said filter assembly 210, and then repeat the above process in reverse to re-install said fluid filter assembly 210 and resume fluid flow and filter operations.

Figure 2:
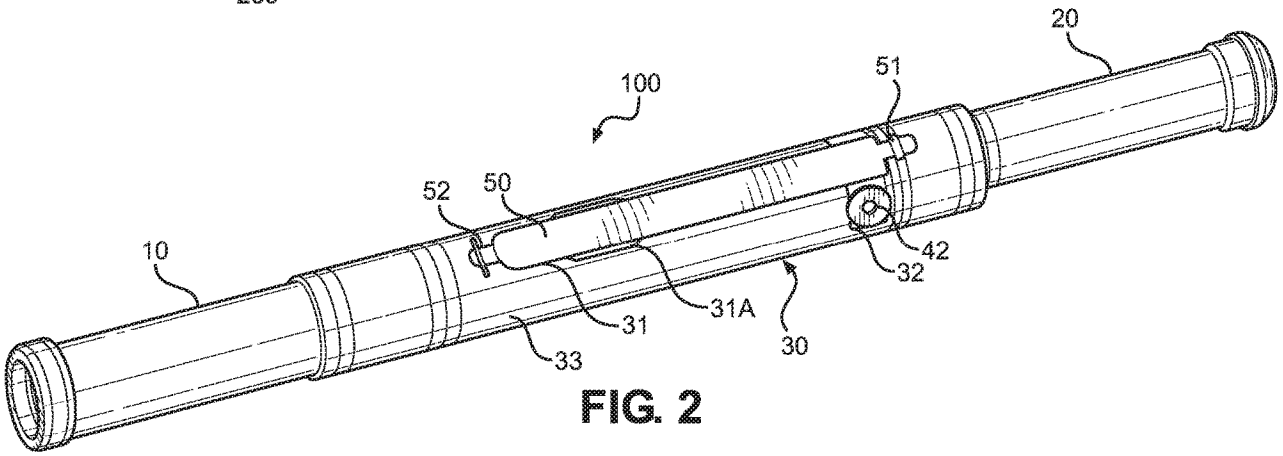
FIG. 2 depicts a side perspective view of a flow line filter assembly of the present invention in a closed, loaded and locked configuration.

FIG. 2 depicts a side perspective view of a flow line filter assembly 100 of the present invention in a closed, loaded and locked configuration. Said flow line filter assembly 100 generally comprises an inlet sub 10, an outlet sub 20 and filter housing assembly 30 disposed there between. Although said inlet sub 10, outlet sub 20 and filter housing assembly 30 are described herein as separate components, it is to be observed that said components can comprise a member of singular or unitary construction without departing from the scope of the present invention. Said filter housing assembly 30 generally comprises a cylindrical body or housing member 33 having a central through bore 34 (not visible in FIG. 2), and an elongate slot or opening 31; in a preferred embodiment, said elongate slot 31 is oriented substantially parallel to the longitudinal axis of said housing member 33, and its central through bore 34. Said elongate slot 31 further comprises transverse side notch or recess 32, as well as section 31A wherein the width of said elongate slot 31 is larger than other portions of elongate slot 31. Said side notch or recess 32 extends in a substantially perpendicular orientation from the longitudinal axis of said elongate slot 31.

Although not visible in the configuration depicted in FIG. 2, an elongate filter locking sleeve member 40 having body section 41 and locking extension 42 is disposed within an elongate central bore of housing 33 (as discussed more fully herein). Cover member 50 is hingedly attached to said housing 33 via hinge 52 or other hinge mechanism well known to those having skill in the art. In the embodiment depicted in FIG. 2, hinged cover 50 is depicted in a closed position, and is disposed within elongate slot 31.

Figure 3:
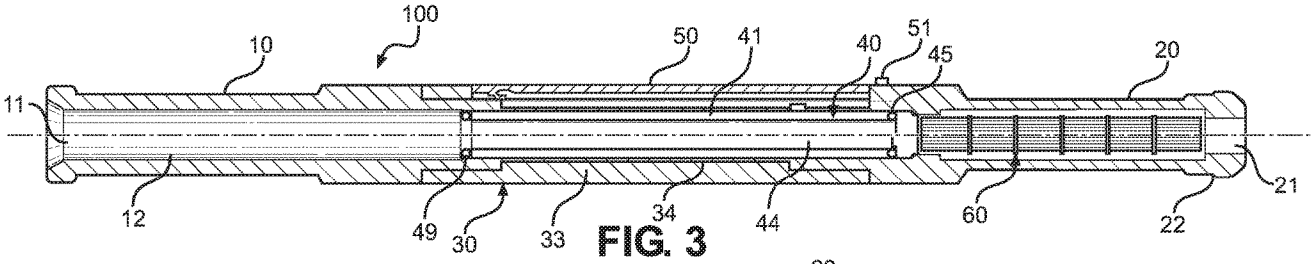
FIG. 3 depicts a side sectional view of a flow line filter assembly of the present invention in a closed, loaded and locked configuration.

FIG. 3 depicts a side sectional view of a flow line filter assembly 100 of the present invention in a closed, loaded and locked configuration. Said flow line filter assembly 100 generally comprises inlet sub 10 having central through bore 11 defining inner surface 12. Outlet sub 20 has central through bore 21 and end connection member 22. Filter housing assembly 30 disposed between, and axially aligned with, inlet sub 10 and outlet sub 20. Filter locking sleeve member 40 having body section 41, locking extension 42 and central through bore 44 is disposed within central bore 34 of housing 33. In the embodiment depicted in FIG. 3, central through bore 11 of inlet sub 10, central through bore 21 of outlet sub 20, and central through bore 44 of filter locking sleeve member 40 are all axially aligned with each other.

Still referring to FIG. 3, hinged cover 50 is attached to housing 33 of filter housing assembly 30 via hinge member 52. As depicted in FIG. 3, said hinged cover 50 is shown in a closed position, and is received within elongate slot 31 of housing 33 of filter housing assembly 30. Elongate and substantially cylindrical slotted filter assembly 60 is received within internal bore 21 of outlet sub 20.

Figure 4:
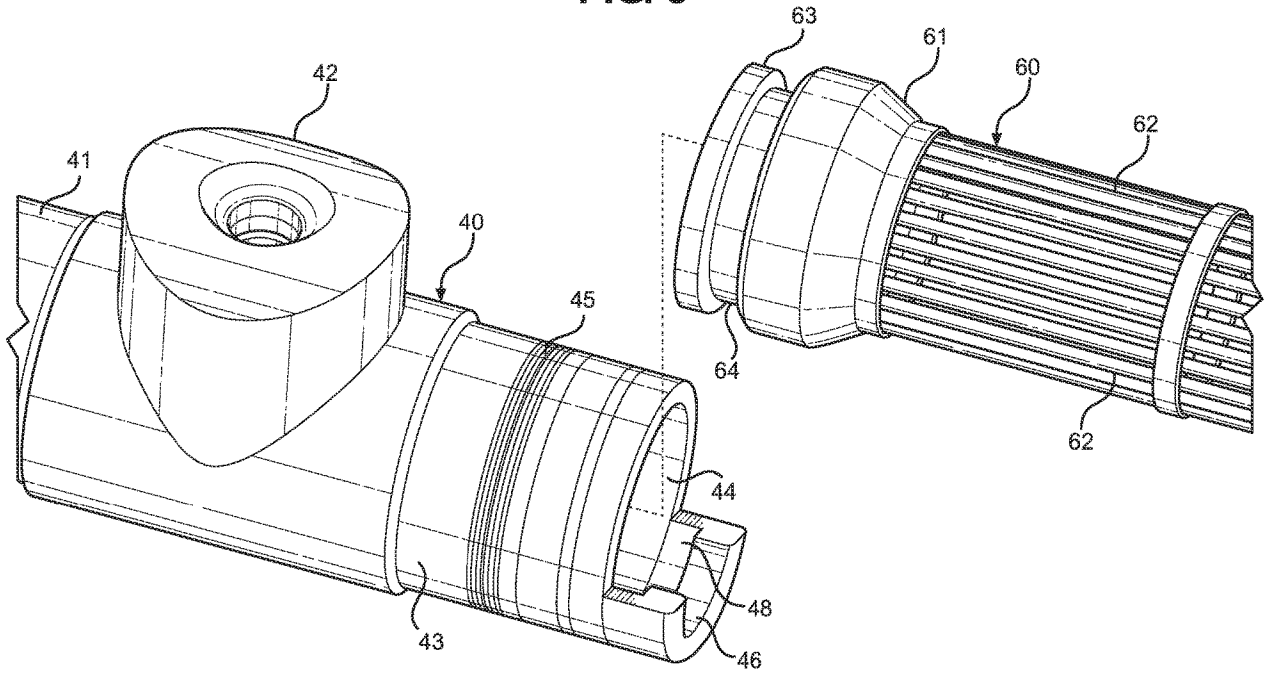
FIG. 4 depicts a side perspective view of a filter lock attachment assembly of the present invention.

FIG. 4 depicts a side perspective and partially exploded view of a portion of filter locking sleeve 40 of the present invention that can be joined in mating relationship with filter assembly 60. Although the construction and configuration of said filter assembly 60 can vary without departing from the scope of the present invention, in a preferred embodiment said filter assembly 60 has a substantially cylindrical shape and generally comprises inlet head 61 and screen filter section 62 having a plurality of spaced apart members defining elongate gaps or openings having predetermined and desired dimensions and configurations.

Filter locking sleeve 40 generally comprises body section 41 and knob-like locking extension 42 that protrudes radially outward from the longitudinal axis of said body section 41. Said locking sleeve 40 also comprises seal extension 43. At least one seal member (such as an O-ring or other elastomeric material well known to those having skill in the art) are disposed on the outer surface of said seal extension 43. Additionally, a connection extension member 46 defining connection groove 48 is disposed at or near the end of seal extension 43. Still referring to FIG. 4, inlet head 61 of filter assembly 60 further comprises a connection extension member 63 defining a connection groove 64 disposed at or near the end of said inlet head 61.

In a preferred embodiment, said locking sleeve 40 and filter assembly 60 can be operationally attached in end-to-end orientation. Specifically, connection extension 63 can be sized and configured to be received within connection groove 48, while connection extension 46 can similarly be sized and configured to be received within connection groove 64. In this manner, said locking sleeve 40 and filter assembly 60 can be temporarily linked or attached to each other when desired, yet also quickly and easily separated when desired. Notwithstanding the foregoing, it is to be observed that other methods of temporary operational connection and disconnection of said locking sleeve 40 and filter assembly 60 relative to each other can be employed without departing from the scope of the present invention.

FIGS. 5 through 14 depict sequential views of a method and process of removing and reinstalling a filter assembly 60 from flow line filter assembly 100.

FIG. 5 depicts a perspective view of a flow line filter assembly 100 of the present invention in a closed, loaded and locked configuration. Filter locking sleeve 40 (not visible in FIG. 5) having locking extension 42 is disposed within housing member 30; said filter locking sleeve 40 can be rotated about its longitudinal axis in order to position locking extension 42 within transverse side notch 32, thereby preventing said locking sleeve member 40 from moving axially along the longitudinal axis of filter housing assembly 30. Hinged cover 50 is depicted in the closed position and received within elongate slot 31 of filter housing assembly 30, and is secured in said closed position using latch member 51. In the configuration depicted in FIG. 5, hinged cover 50 retains locking extension 42 in transverse side notch 32, and blocks said locking extension 42 from entering elongate slot 31. As such, hinged cover 50 prevents filter locking sleeve 40 from rotating about its longitudinal axis. Although not visible, elongate and substantially cylindrical slotted filter assembly 60 is received within internal bore 21 of outlet sub 20.

FIG. 6 depicts a perspective view of a flow line filter assembly 100 of the present invention in a loaded and locked configuration, with a hinged cover member 50 open. Although other means of opening hinged cover member 50 can be employed without departing from the scope of the present invention, it is to be observed that a user can insert fingers and/or thumbs into expanded section 31A of elongate slot 31 in order to efficiently and securely grasp cover member 50 in order to lift said cover member 50. Filter locking sleeve 40 having locking extension 42 is disposed within central flow bore 34 of housing member 33. As also depicted in FIG. 5, said locking extension 42 remains positioned within transverse side notch 32. However, said hinged cover 50 is depicted in the open position, and is not disposed in elongate slot 31; as such, hinged cover 50 no longer blocks locking extension 42 from entering elongate slot 31, or prevents filter locking sleeve 40 from rotating about its longitudinal axis.

Figure 7:
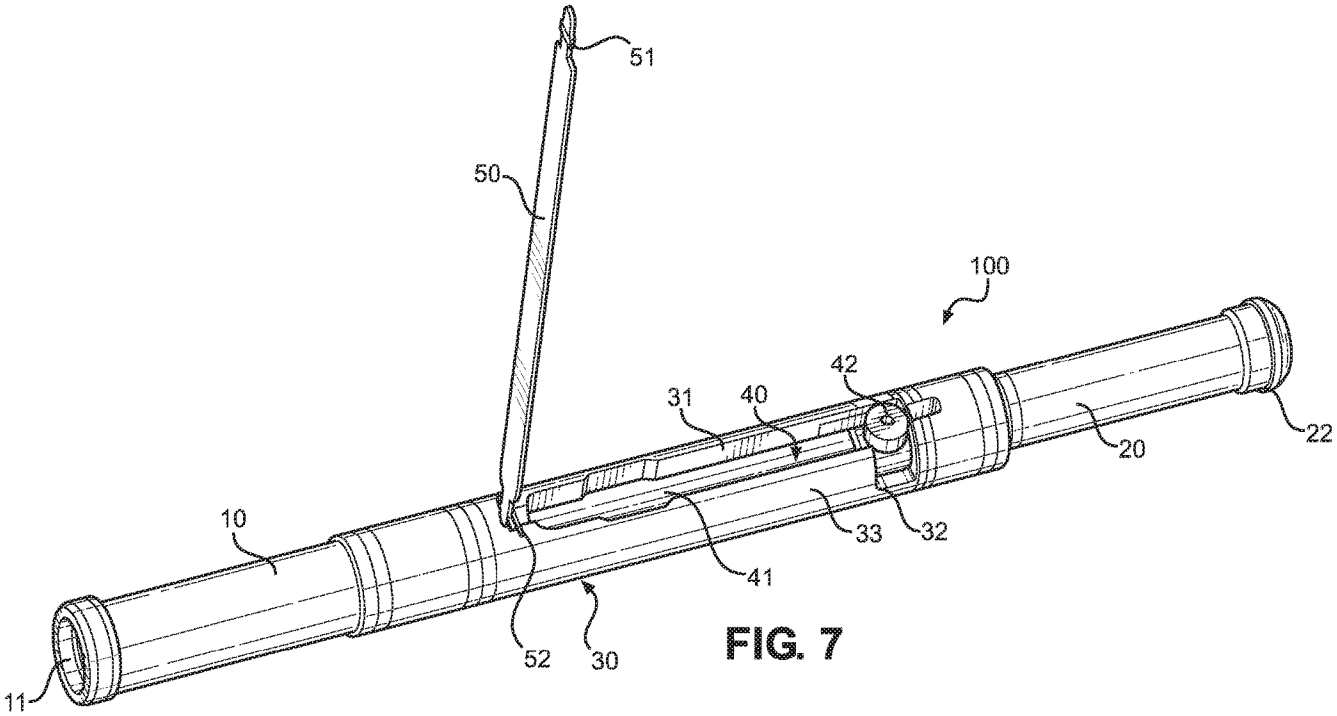
FIG. 7 depicts a perspective view of a flow line filter assembly of the present invention in a loaded and unlocked configuration, with a hinged cover member open.

FIG. 7 depicts a perspective view of a flow line filter assembly 100 of the present invention in a loaded and unlocked configuration, with hinged cover 50 open. Filter locking sleeve 40 having protruding locking extension 42 is disposed within central flow bore 34 of housing member 33; compared to FIG. 6, said filter locking sleeve 40 has been rotated about its longitudinal axis in order to remove or shift locking extension 42 out of transverse side notch 32 and into elongate slot 31. In this position, locking extension 42 is free to move axially within elongate slot 31, and filter locking sleeve 40 is likewise free to move axially within central flow bore 34 of housing 33 of filter housing assembly 30. Although not visible in this figure, elongate and substantially cylindrical slotted filter assembly 60 is still received within internal bore 21 of outlet sub 20.

Figure 8:
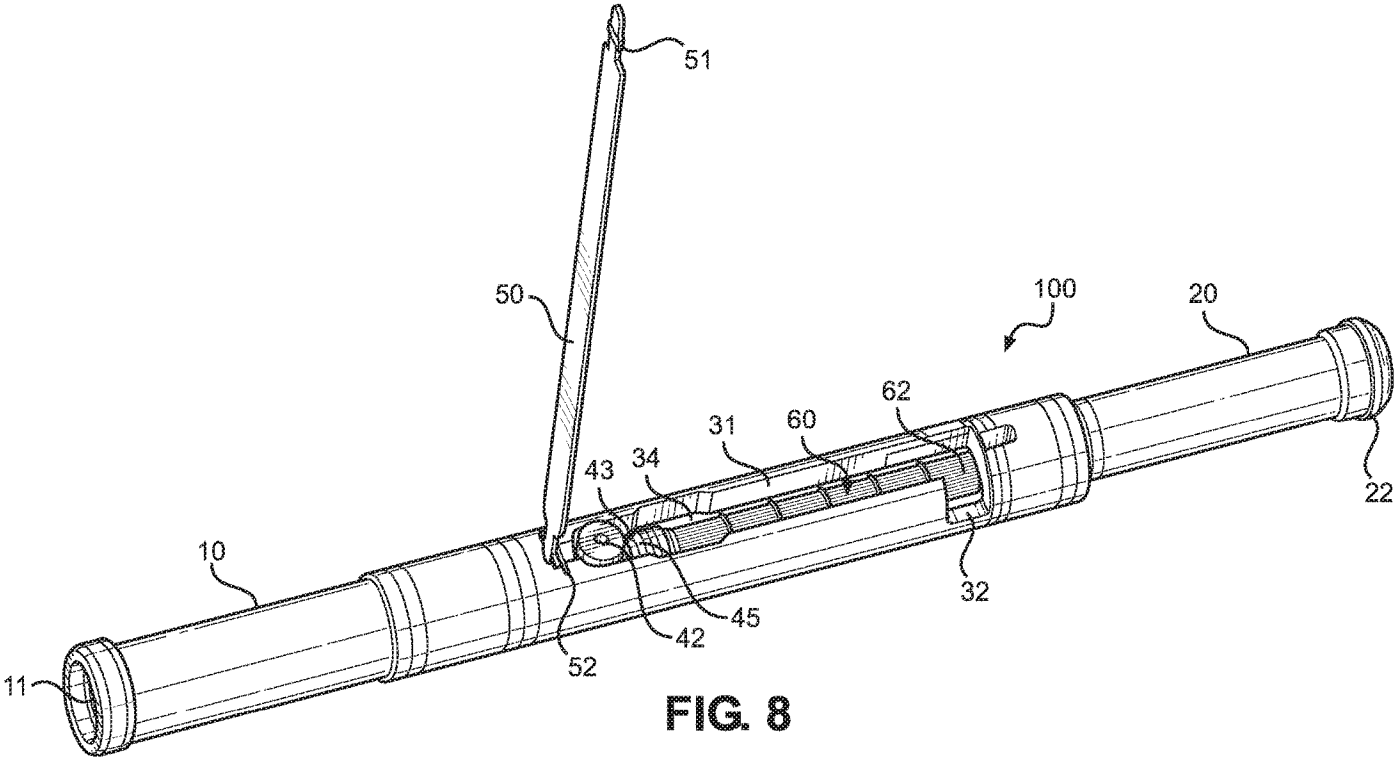
FIG. 8 depicts a perspective view of a flow line filter assembly of the present invention in a partially unloaded and unlocked configuration, with a hinged cover member open.

FIG. 8 depicts a perspective view of a flow line filter assembly 100 of the present invention in a partially unloaded and unlocked configuration, with hinged cover member 50 open. Filter locking sleeve 40 is shifted axially within central flow bore 34 of housing assembly 30, moving body section 41 of said filter locking sleeve 40 into central flow bore 11 of inlet sub 10 (more clearly depicted in FIG. 3); as depicted in FIG. 8, seal extension 43 having seal members 45 remains within central flow bore 34 of housing 33 of filter housing assembly 30. Elongate and substantially cylindrical slotted filter assembly 60, which is operationally attached to said filter locking sleeve 40, is, in turn, shifted (pulled) from internal bore 21 of outlet sub 20 and repositioned into central through bore 34 of housing 33 of filter housing assembly 30. In this configuration, said slotted filter assembly 60 is aligned with elongate slot 31.

Figure 9:
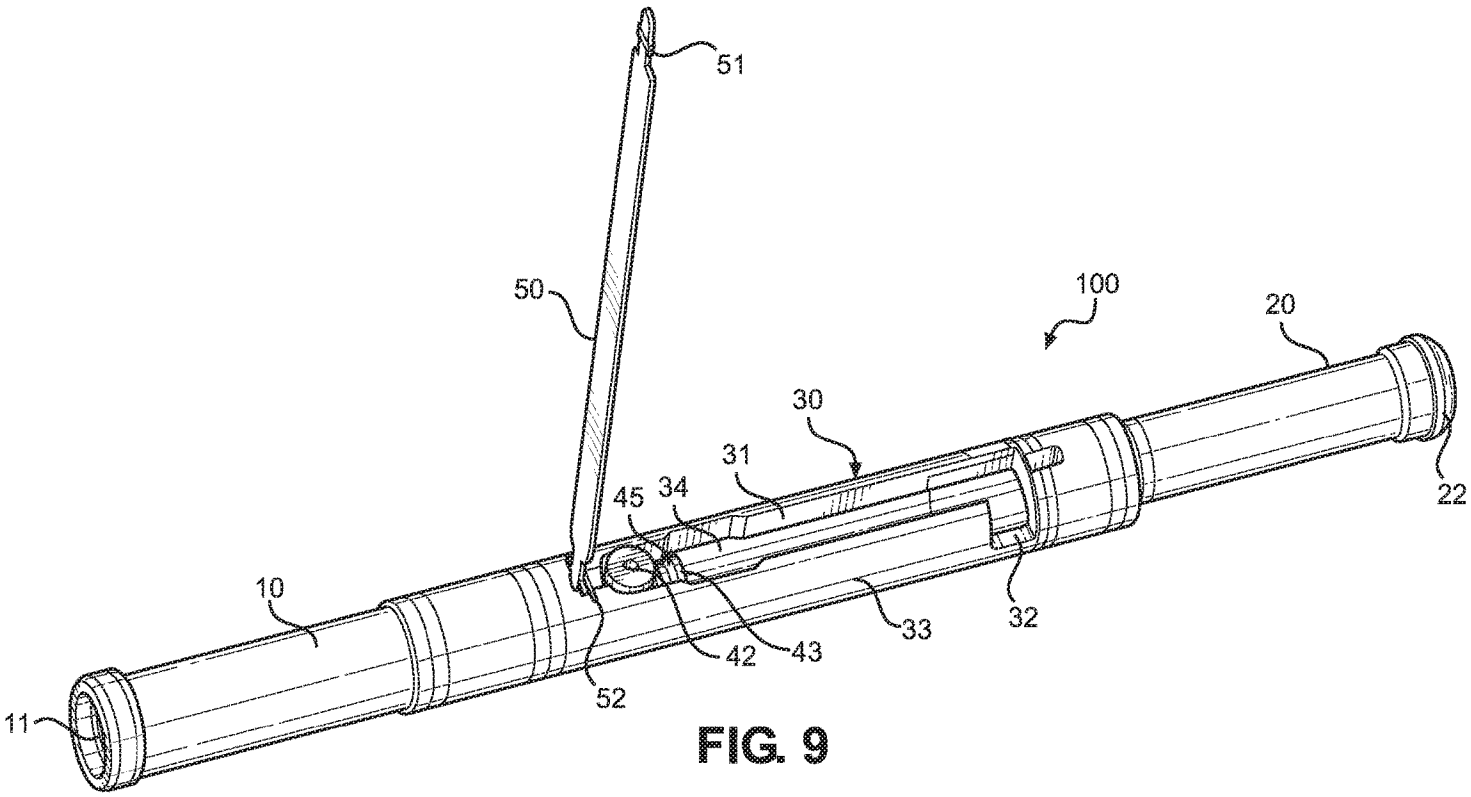
FIG. 9 depicts a perspective view of a flow line filter assembly of the present invention in a fully unloaded and unlocked configuration, with a hinged cover member open and a screen member removed.

FIG. 9 depicts a perspective view of a flow line filter assembly 100 of the present invention in substantially the same configuration as depicted in FIG. 8, except that filter assembly 60 has been separated from filter locking sleeve 40 and removed from central through bore 34 of housing 33 of filter housing assembly 30 through elongate slot 31. Body section 41 of filter locking sleeve 40 remains within central flow bore 11 of inlet sub 10 (more clearly depicted in FIG. 3), while seal extension 43 having seal members 45 remains within central flow bore 34 of housing 33 of filter housing assembly 30. The filter assembly 60 removed from central through bore 34 can be cleaned by removing debris, solids and/or other foreign material captured by said filter assembly 60 (that is, filtered from a fluid flow stream flowing through flow line filter assembly 100) for subsequent reuse.

Figure 10:
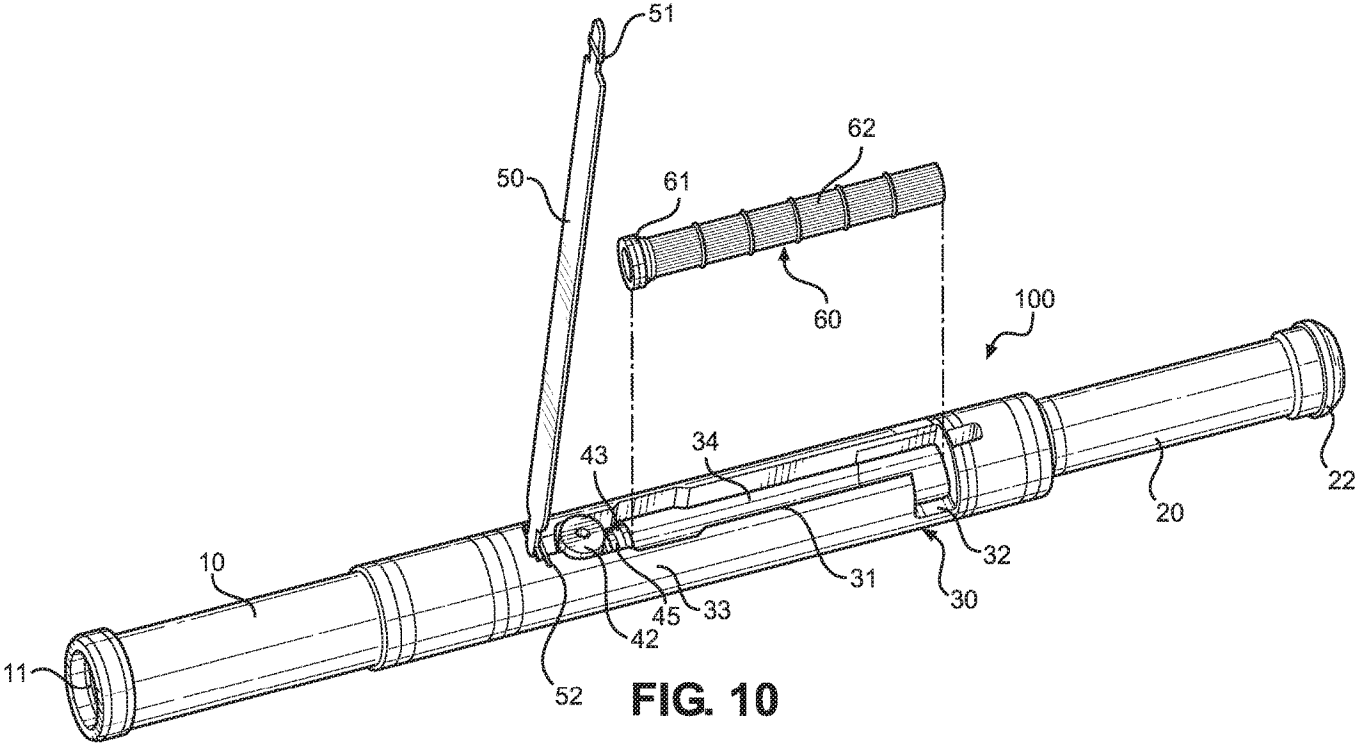
FIG. 10 depicts a partially exploded perspective view of a flow line filter assembly of the present invention in a fully unloaded and unlocked configuration, with a hinged cover member open and a screen member being installed.

FIG. 10 depicts a partially exploded perspective view of said flow line filter assembly 100 of the present invention in a fully unloaded and unlocked configuration, with hinged cover member 50 open and filter assembly 60 being installed through elongate slot 31 and into central through bore 34 of housing 33 of filter housing assembly 30. Body section 41 of filter locking sleeve 40 remains within central flow bore 11 of inlet sub 10 (more clearly depicted in FIG. 3), while seal extension 43 having seal members 45 remains within central flow bore 34 of housing 33 of filter housing assembly 30. It is to be observed that filter assembly 60 can comprise the same filter assembly depicted in FIG. 8 after being cleaned and having debris removed; alternatively, said filter assembly 60 depicted in FIG. 10 can be a substantially identical replacement filter assembly.

Figure 11:
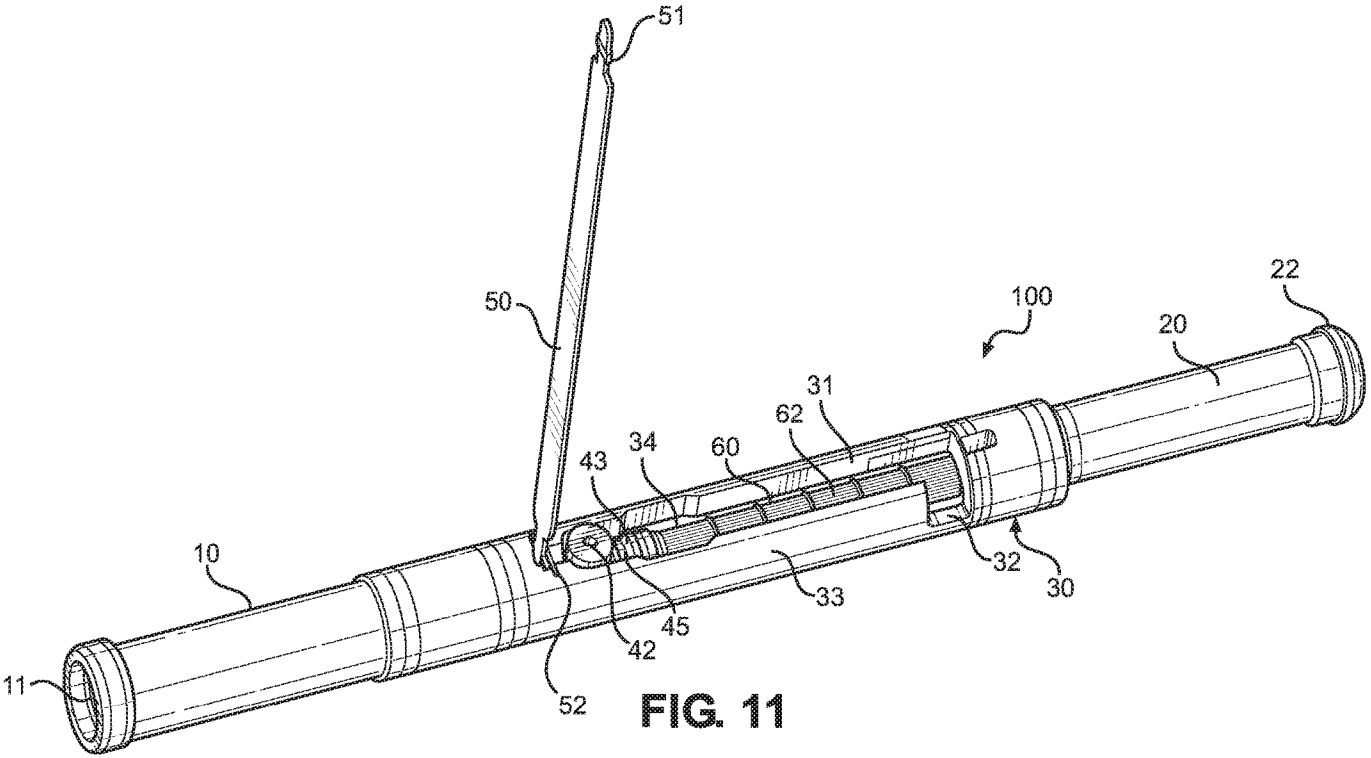
FIG. 11 depicts a perspective view of a flow line filter assembly of the present invention in a partially loaded and unlocked configuration, with a hinged cover member open.

FIG. 11 depicts a perspective view of flow line filter assembly 100 of the present invention in a partially loaded and unlocked configuration, with hinged cover member 50 in an open position. Although not fully visible in FIG. 11, filter locking sleeve 40 is received within central flow bore 11 of inlet sub 10, while seal extension 43 having seal members 45 remains within central flow bore 34 of housing 33 of filter housing assembly 30. Elongate and substantially cylindrical slotted filter assembly 60 is installed into central through bore 34 of housing 33 of filter housing assembly 30 through elongate slot 31. In a preferred embodiment, said filter assembly 60 is operationally connected to filter locking sleeve 40 in end-to-end arrangement as depicted in FIGS. 3 and 4 (or other alternative means of attachment).

Figure 12:
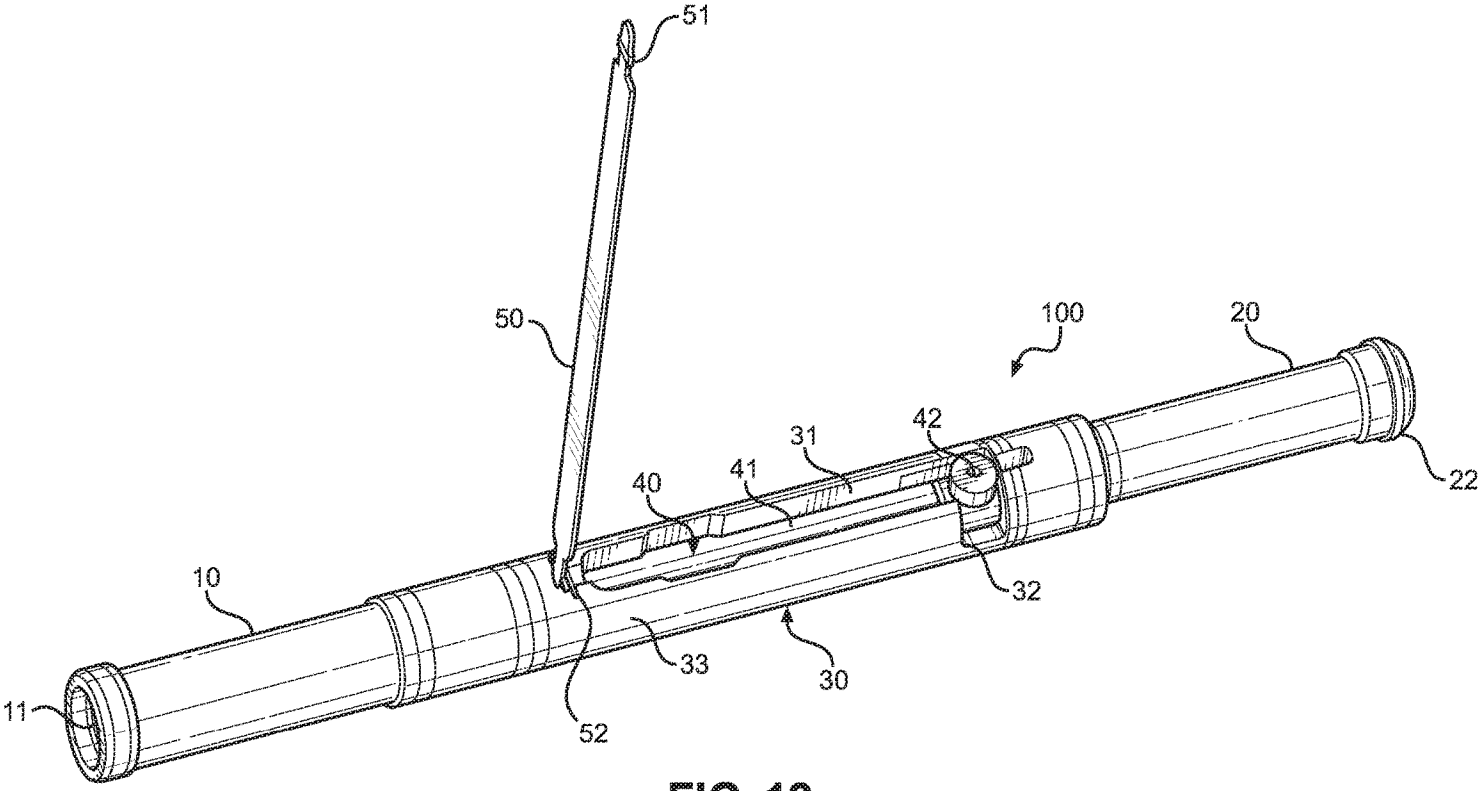
FIG. 12 depicts a perspective view of a flow line filter assembly of the present invention in a loaded and unlocked configuration, with a hinged cover member open.

FIG. 12 depicts a perspective view of flow line filter assembly 100 of the present invention in a loaded and unlocked configuration, with hinged cover member 50 in an open position. Filter locking sleeve 40 having locking extension 42 is disposed within central flow bore 34 of housing 33 of filter housing assembly 30; in the configuration depicted in FIG. 12, locking extension 42 is not received with in transverse side notch 32 and is free to move within elongate slot 31. Said filter locking sleeve 40 is likewise free to move axially within central flow bore 34 of housing 33 of filter housing assembly 30. Although not visible in this figure, in this configuration elongate and substantially cylindrical slotted filter assembly 60 is no longer aligned with elongate slot 31 and is shifted (forced) into internal bore 21 of outlet sub 20.

Figure 13:
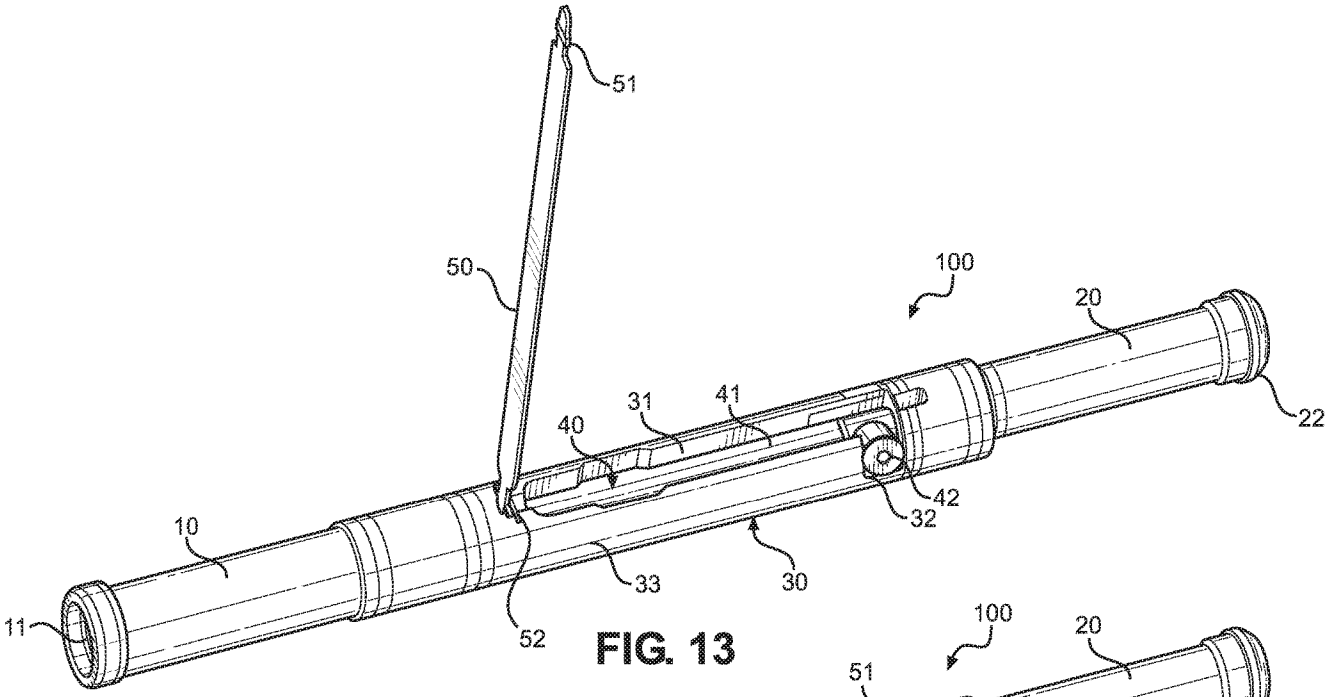
FIG. 13 depicts a perspective view of a flow line filter assembly of the present invention in a loaded and locked configuration, with a hinged cover member open.

FIG. 13 depicts a perspective view of flow line filter assembly 100 of the present invention in a loaded and locked configuration, with hinged cover member 50 in an open position. Filter locking sleeve 40 can be rotated about its longitudinal axis in order to position locking extension 42 within transverse side notch 32, thereby preventing said locking extension 42 from moving axially within elongate slot 31, and attached filter locking sleeve 40 from moving axially within central bore 34 of housing 33 along the longitudinal axis of filter housing assembly 30. Although not visible in FIG. 13, it is to be observed that elongate and substantially cylindrical slotted filter assembly 60 is received within internal bore 21 of outlet sub 20.

Figure 14:
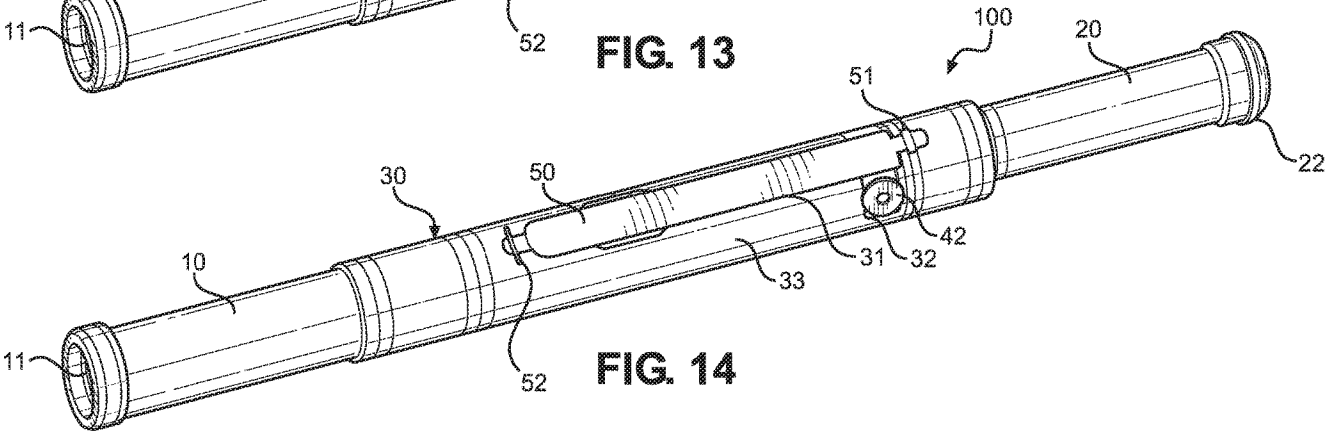
FIG. 14 depicts a perspective view of a flow line filter assembly of the present invention in a closed, loaded and locked configuration.

FIG. 14 depicts a perspective view of flow line filter assembly 100 of the present invention in a closed, loaded and locked configuration. Said hinged cover 50 is in the closed position, and is received within elongate slot 31 of filter housing assembly 30. Said cover member 50 is secured in said position using latch member 51. In this position, cover 50 is received within elongate slot 31 and substantially blocks or fills said slot, thereby preventing said locking extension 42 from moving or rotating out of transverse side notch 32; in this configuration, locking extension 42 is prevented from moving axially within elongate slot 31, and attached filter locking sleeve 40 is likewise prevented from moving axially within central bore 34 of housing 33 of filter housing assembly 30.

Figure 15:
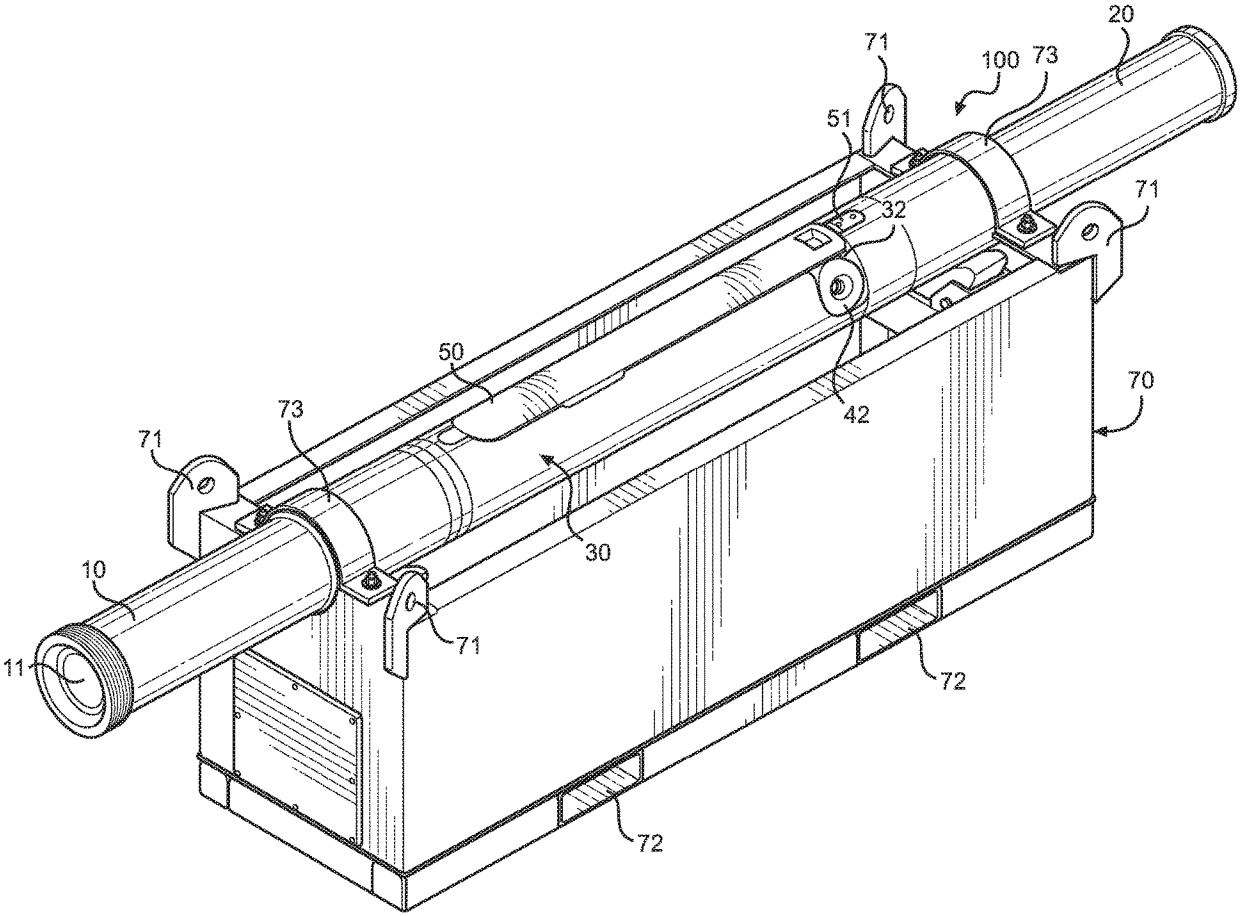
FIG. 15 depicts a perspective view of a flow line filter assembly of the present invention in a loaded and locked configuration and mounted on a box member, such as during use filtering fluid.

FIG. 15 depicts a perspective view of a flow line filter assembly 100 of the present invention in a loaded and locked configuration and mounted on a box member 70, such as during use filtering fluid. It is to be observed that box member 70 can comprise a shipping container having desired dimensions that can be used for securely containing flow line filter assembly 100 during transportation, or for storage during periods of non-use. During use, said box member 70 can comprise a platform or base for supporting flow line filter assembly 100. Additionally, box member 70 can function as a reservoir or catch basin for containing any drilling fluid or other liquids that may escape or leak out of flow line filter assembly 100 when cover member 50 is opened and filter locking sleeve 40 and/or filter assembly 60 are removed from said flow line filter assembly 100, thereby preventing said drilling fluid or other liquids from being released onto the drilling rig floor or surrounding environment.

In a preferred embodiment, said box member 70 can comprise pad-eyes 71 for convenient and secure attachment of slings or other lifting devices to said box member 70. Said box member 70 can also include spaced slots 72 for receiving forks of a fork lift. Further, said box member 70 further includes mounting brackets or braces 73 for temporarily securing flow line filter assembly 100 to box member 70 during use.

During operation, as fluids are pumped through inline filter assembly 100 of the present invention, filter assembly 60 removes (filters) solids and/or other debris from said fluid stream. Such removed/filtered solids and/or other debris are typically captured within filter assembly 60. When desired, said pumping and fluid flow can be interrupted; during such period(s) when fluid flow is interrupted, filter locking sleeve 40 can be unlocked and shifted, thereby aligning filter assembly 60 with elongate slot 31. Said filter assembly 60 can be removed from said inline filter assembly 100 via said slot 31 in the manner described herein. Said filter assembly 60 can be cleaned and reinstalled, or replaced with a clean replacement filter assembly, via slot 31. Filter locking sleeve 40 can be shifted and locked, moving filter assembly 60 out of alignment with elongate slot 31, and into internal bore 21 of outlet sub 20. Thereafter, pumping and fluid flow can be resumed through said inline filter assembly 100, with filter assembly 60 removing (filtering) solids and/or other debris from said fluid stream.

The inline locking mechanism of the present invention allows a filter assembly 60 to be quickly and efficiently extracted and replaced without the need to access the ends of a conventional filter assembly. Referring back to FIG. 3, seal members 45 provide a fluid pressure seal between the external surface of filter locking sleeve 40 and the inner surface of bore 21 of outlet sub 20. Similarly, seals 49 provide a fluid pressure seal between the external surface of filter locking sleeve 40 and the inner surface 12 of bore 11 of inlet sub 10.

Still referring to FIG. 3, in this configuration, high pressure fluid can flow through central through bore 11 of inlet sub 10, central through bore 44 of filter locking sleeve 40, and central through bore 21 of outlet sub 20. However, in this configuration, inner bore 34 of housing 33 of filter housing assembly 30 is isolated from, and is not exposed to, such elevated fluid pressures. In certain embodiments, the present invention can be utilized without cover 50 because said cover is not required to hold or seal against fluid pressure. However, when cover 50 is employed, said cover 50 can only be fully closed and locked if/when locking extension 42 is in the fully shifted position and received in transverse side notch 32, providing a visual indication of system readiness. Cover 50 also prevents filter locking sleeve 40 from accidental or unintended rotation that could allow said filter locking sleeve 40 to open under fluid pressure. For example, unlike conventional fluid filtration assemblies, the present invention permits removal, cleaning/replacement, and reinstallation of a filter apparatus within said fluid filter assembly 100 in the manner described in detail herein during the period that mud pumps are typically idle (not pumping), such as when threaded connections of a drill string are being made up or broken out.

Although the technology disclosed herein is described primarily in connection with inline filtration assemblies for drilling fluid and the like, it is to be observed that the present invention can be used in other applications such as, for example, the quick and efficient installation and removal of objects from pressurized containers/vessels. Further, an automated design (such as at least one fluid powered cylinder or linear actuator) can be employed to shift locking member 40 axially within central bore 34 of housing 33 of housing assembly 30 when desired.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An inline filter assembly for removing debris and other solid materials from a fluid stream comprising:

a) an elongate housing member having a length, a central through bore and an elongate slot extending through said housing member along a portion of said length and having an transverse notch;

b) a filter locking sleeve having a first end, a second end, a central through bore and a protrusion extending from an outer surface of said locking sleeve, wherein said filter locking sleeve is slidably disposed within said central through bore of said elongate housing member, said protrusion is slidably disposed within said elongate slot, and said filter locking sleeve is secured against axial movement when said protrusion is disposed in said transverse notch of said elongate slot;

c) a filter apparatus slidably disposed within said central through bore of said elongate housing member and operationally attached to said first end of said filter locking sleeve, wherein said filter apparatus is configured to alternate between a first position wherein said filter apparatus is aligned with said elongate slot and a second position wherein said filter apparatus is not aligned with said elongate slot; and d) a door member hingedly attached to said elongate housing member, wherein said door member is configured to alternate between a first open position, and a second closed position wherein said door member is at least partially received within said elongate slot, and wherein said door member prevents said protrusion from moving out of said transverse notch when said door member is in said second closed position.

2. An inline filter assembly for removing debris and other solid materials from a fluid stream comprising:

a) an elongate housing member having a length, a central through bore and an elongate slot extending through said housing member along a portion of said length, wherein said elongate slot further comprises a transverse notch;

b) a door hingedly attached to said elongate housing member, wherein said door is configured to alternate between a first open position, and a second closed position wherein said door is at least partially received within said elongate slot;

c) a filter locking sleeve having a first end, a second end, a central through bore, an outer surface and a locking protrusion extending from said outer surface, wherein said filter locking sleeve is slidably disposed within said central through bore of said elongate housing member, and said locking protrusion is slidably disposed within said elongate slot; and d) a filter apparatus slidably disposed within said central through bore of said elongate housing member and operationally attached to said first end of said filter locking sleeve, wherein said filter apparatus is configured to alternate between a first position wherein said filter apparatus is aligned with said elongate slot and a second position wherein said filter apparatus is not aligned with said elongate slot.

3. The inline filter assembly of claim 2, further comprising at least one seal member at said first end of said filter locking sleeve, wherein said at least one seal member at said first end of said filter locking sleeve forms a fluid pressure seal with said elongate housing member.

4. The inline filter assembly of claim 2, further comprising at least one seal member at said second end of said filter locking sleeve, wherein said at least one seal member at said second end of said filter locking sleeve forms a fluid pressure seal with said elongate housing member.

5. The inline filter assembly of claim 2, wherein said filter apparatus comprises a screen filter.

6. The inline filter assembly of claim 2, wherein said filter locking sleeve is secured against axial movement when said protrusion is disposed in said transverse notch of said elongate slot.

7. The inline filter assembly of claim 6, wherein said door prevents said protrusion from moving out of said transverse notch when said door is in said second closed position.

8. The inline filter assembly of claim 2, further comprising a latch member for selectively securing said door in said second closed position.

9. A method for removing debris and other solid materials from a fluid stream comprising:

a) providing an inline filter assembly, wherein said inline filter assembly further comprises:

i) an elongate housing member having a length, a central through bore and an elongate slot extending through said housing member along a portion of said length, wherein said elongate slot further comprises a transverse notch;

ii) a door hingedly attached to said elongate housing member, wherein said door is configured to alternate between a first open position, and a second closed position wherein said door is at least partially received within said elongate slot;

iii) a filter locking sleeve having a first end, a second end, a central through bore, an outer surface and a locking protrusion extending from said outer surface, wherein said filter locking sleeve is disposed within said central through bore of said elongate housing member, said locking protrusion is received within said transverse notch, and said filter locking sleeve is secured against axial movement;

iv) a filter apparatus disposed within said central through bore of said elongate housing member and operationally attached to said first end of said filter locking sleeve, wherein said filter apparatus is configured to alternate between a first position wherein said filter apparatus is aligned with said elongate slot and a second position wherein said filter apparatus is not aligned with said elongate slot;

v) at least one first seal member at said first end of said filter locking sleeve, wherein said at least one first seal member forms a fluid pressure seal with said elongate housing member;

vi) at least one second seal member at said second end of said filter locking sleeve, wherein said at least one second seal member forms a fluid pressure seal with said elongate housing member;

b) pumping said fluid stream through said inline filter assembly; and c) capturing debris and other solid materials from said fluid stream in said filter apparatus.

10. The method of claim 9, further comprising:

a) ceasing the flow of said fluid stream through said inline filter assembly;

b) opening said door;

c) rotating said filter locking sleeve to remove said locking protrusion from said transverse notch;

d) shifting said filter locking sleeve within said central through bore of said elongate housing member to align said filter apparatus with said elongate slot; and e) removing said filter apparatus through said elongate slot.

11. The method of claim 10, further comprising installing a clean filter apparatus into said central through bore of said elongate housing member through said elongate slot.

12. The method of claim 11, further comprising:

a) shifting said filter locking sleeve within said central through bore of said elongate housing member to align said locking protrusion with said transverse notch;

b) rotating said filter locking sleeve to position said locking protrusion in said transverse notch; and c) closing said door.

13. The method of claim 11, further comprising resuming pumping said fluid stream through said inline filter assembly.

* * * * *